US008474209B2

(12) United States Patent
Garcia

(10) Patent No.: US 8,474,209 B2
(45) Date of Patent: Jul. 2, 2013

(54) PRECISION SURFACE TECHNOLOGY

(75) Inventor: Eugenio Cruz Garcia, Gandia (ES)

(73) Assignee: Faus Group, Inc., Calhoun, GA (US)

( * ) Notice: Subject to any disclaimer, the term of this patent is extended or adjusted under 35 U.S.C. 154(b) by 1203 days.

(21) Appl. No.: 12/007,582

(22) Filed: Jan. 11, 2008

(65) Prior Publication Data

US 2009/0178359 A1 Jul. 16, 2009

(51) Int. Cl.
*E04B 2/08* (2006.01)

(52) U.S. Cl.
USPC ..... 52/391; 52/392; 52/403.1

(58) Field of Classification Search
USPC ..... 52/391, 392, 403.1, 589.1, 796.1, 52/177
See application file for complete search history.

(56) References Cited

U.S. PATENT DOCUMENTS

| | | | | |
|---|---|---|---|---|
| 1,660,480 | A * | 2/1928 | Daniels | 52/390 |
| 1,929,871 | A * | 10/1933 | Jones | 52/509 |
| 2,027,292 | A * | 1/1936 | Rockwell | 52/396.1 |
| 3,971,181 | A * | 7/1976 | Zetlin | 52/263 |
| 5,182,891 | A * | 2/1993 | Slocum | 52/480 |
| 5,323,575 | A * | 6/1994 | Yeh | 52/177 |
| 5,438,809 | A * | 8/1995 | Ehrlich | 52/390 |
| 5,755,068 | A | 5/1998 | Ormiston | |
| 6,694,689 | B1 * | 2/2004 | Scott et al. | 52/392 |
| 6,694,691 | B2 * | 2/2004 | Ku | 52/403.1 |
| 6,718,714 | B1 * | 4/2004 | Montgomery, Sr. | 52/392 |
| 7,487,622 | B2 * | 2/2009 | Wang | 52/384 |
| 2004/0074191 | A1 * | 4/2004 | Garcia | 52/592.1 |
| 2005/0129913 | A1 | 6/2005 | Kobayashi et al. | |
| 2006/0191222 | A1 | 8/2006 | Sabater et al. | |
| 2008/0005998 | A1 * | 1/2008 | Pervan | 52/589.1 |
| 2008/0010931 | A1 * | 1/2008 | Pervan et al. | 52/403.1 |
| 2008/0124530 | A1 * | 5/2008 | Paradis et al. | 428/213 |
| 2008/0184647 | A1 * | 8/2008 | Yau | 52/589.1 |

FOREIGN PATENT DOCUMENTS

| | | |
|---|---|---|
| JP | 2005-009140 | 1/2005 |

* cited by examiner

*Primary Examiner* — Richard E. Chilcot, Jr.
*Assistant Examiner* — Alp Akbasli
(74) *Attorney, Agent, or Firm* — Vedder Price P.C.

(57) ABSTRACT

A laminate flooring system includes planks with tile patterns thereon, the tiles of a plank being separated by a precisely formed and positioned interior bevel. The edges of the plank have a bevel as well. The width of the edge bevel is precisely determined and selected such that when two planks are placed adjacent to each other, the adjacent edge patterns combine to form a bevel whose with and appearance is the same as the interior bevels between the tiles of a single plank.

14 Claims, 4 Drawing Sheets

PRECISION SURFACE TECHNOLOGY

This application incorporates by reference U.S. Pat. Nos. 6,401,415; 6,688,061; 6,638,387; and 6,691,480. This application also incorporates by reference U.S. patent application Ser. Nos. 10/352,189; 10/352,248; 10/374,751; 10/689,510; 10/678,219; 10/885,230; 11/066,101; 10/981,756; and 10/981,759 for all purposes as if fully incorporated herein.

BACKGROUND OF THE INVENTION

1. Field of the Invention

The present invention relates to surface technologies relating to laminate flooring, and in particular surface technologies for enhancing the natural appearance of laminate flooring.

2. Discussion of the Related Art

Conventional laminate flooring depicting an arrangement of square tiles made of a number of wooden strips running in different directions, such as a parquet pattern, attempts to provide a realistic looking laminate floor by providing a number of single piece, unitary laminate flooring planks the size of a single tile and arranging these single-tile planks together to make the floor pattern. When used in this context, tiles does not refer to ceramic tile, but is used to refer to generally to any substantially square shaped pattern element or group of elements that has sides equal to the width of the plank. This can include a square pattern made up of smaller strips having wood, marble or stone patterns.

In the related art, square planks the size of a single pattern tile are used because it is very difficult to make the boundary lines between tiles within a rectangular plank having a number of tiles look identical to and have an identical surface texture feel as the boundaries between adjacent planks.

As illustrated in FIG. 1, laminate flooring planks according to the related art are the size of the single tile. That single tile depicts wooden strips which may be bounded solely by dark lines in the pattern or by bevels. But the bevels within the plank around these wooden strips and the bevels around the edge of the plank are not the same size. Notably the bevels around the edges tend to be much wider than the bevels or dark lines in the interior of the plank. It is very easy to distinguish the plank edge bevels from the interior tile boundary bevels.

By producing square laminate flooring planks having only a single tile, it was acceptable for the boundary around a tile, which also serves as the boundary around the plank, to be different than the bevel lines within the tile pattern, because the different bevels were at least consistent—the bevels around a tile are one size whereas the bevels between the strips within the tile are another. In other words, even though the edge of the planks and the boundaries between planks were noticeable, it was acceptable as part of the design.

The problem is that because the plank boundaries are noticeably different than the bevels in the interior of the plank, it is obvious to the casual observer that flooring is made of square planks and not made of the individual wood strips depicted in the tile. In other words, it is obvious in this type of flooring that the planks are part of a laminate flooring system and are not real wood. This detracts from the appearance of the floor as well as the overall design.

Furthermore, reducing each plank to the size of only one tile makes the manufacturing processes considerably more expensive and the installation more time consuming, because more time is required to cut large boards into these smaller squares than to cut the larger rectangular planks which are more common in laminate flooring manufacturing. In addition, the rectangular planks are faster to install because each plank covers a greater surface area of the floor than the square planks. In effect, a floor that looks less realistic ends up costing more and taking longer to install.

What is needed is a laminate flooring system having the benefit of planks that depict more than one tile or decorative tile, but which has boundaries along the edges of the plank that are indistinguishable from the pattern boundary lines within the interior region of the plank.

SUMMARY OF THE INVENTION

Accordingly, the present invention is directed to laminate flooring systems and laminate flooring planks with bevels and other surface and pattern features that substantially obviates one or more of the problems due to limitations and disadvantages of the related art.

An advantage of the present invention is to provide a laminate flooring system that has at least two unitary laminate flooring planks, each of said laminate flooring planks having at least two square tiles disposed thereon adjacent one another; said planks having a rectangular shape having a width corresponding to a short side and a length corresponding to a long side; each of said square tiles having four sides and each of said sides having a length equal to the width of the plank; an interior bevel disposed between adjacent tiles of a plank; an edge bevel along each edge of the tiles that falls on an edge of the plank; said interior bevel having a width less than one millimeter; and said edge bevel having a width approximately equal to half the width of the interior bevel, wherein said two planks are placed adjacent one another so that edge bevels of the respective planks are also adjacent; and wherein the combined width of the adjacent edge bevels equals the width of the interior bevel so that the edges between planks is indistinguishable from the interior bevel between adjacent tiles of the plank.

Another advantage of the present invention is to provide laminate flooring system and laminate planks having surface features and pattern elements that distract an observer of the flooring from noticing or focusing on the edges of the planks.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
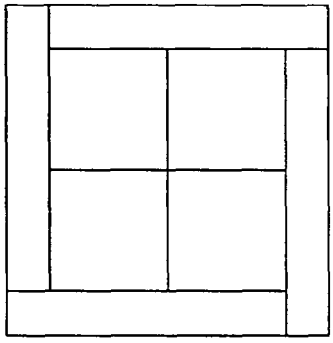
FIGURE 1 Related Art
FIG. 1 illustrates a single tile square laminate flooring plank according to the related art.

Reference will now be made in detail to embodiments of the present invention, examples of which are illustrated in the accompanying drawings.

Laminate flooring planks according to the present invention have plank edge boundaries that are indistinguishable from the boundaries between tiles within the planks. As a result, when planks are placed adjacent one another, it becomes very difficult to distinguish between the boundaries between tiles within a plank and the boundaries between planks. The consistency of boundaries within the plank and between planks hides the plank edge, making it less obvious that the floor is part of a laminate flooring system, and enhances the overall natural appearance of the laminate flooring.

When discussing plank boundaries or plank edges, what is meant is the edge of the surface of the plank. In applications in which the planks are provided with interlocking joints, such as tongue and groove joints which are at least in part milled directly into the plank, the plank edge as discussed herein refers to the edge of the plank's decorative surface, excluding any elements of the interlocking joint which protrude or extend beyond the decorative surface.

To achieve the effect of hiding plank edges and creating the impression that the flooring is made of separate smaller physical elements such as wood strips and blocks rather than being made of large rectangular laminate flooring planks, the boundaries at the edges of the planks and between design elements in the interior of the planks are very precise, very narrow embossed-in-registration bevels. These narrow bevels, or micro-bevels, are less than a millimeter wide, and often about half a millimeter wide and are very precisely located on the elements of the decorative pattern to which they correspond. These decorative pattern elements are typically shadows or seams between strips. Furthermore, the width of the bevels placed along all four edges of the planks are a fraction of the width of the bevels in the interior of the plank between the tiles. Accordingly, when a plank edge bevel are placed adjacent another plank edge bevel, a combined cross-plank or inter-plank bevel is formed that is the same width as the bevels between the tiles in the interior regions of the planks.

The present invention uses bevels of varying lengths and placed in a variety of geometrical shapes within the interior of the plank corresponding to design elements of the pattern or décor paper to disguise, mask or hide the edge of the plank so that it is less noticeable. By using these interior bevels in conjunction with an embossed-in-register surface texture and by placing them parallel to and in close proximity to the edges of the plank, the bevels along the edge of the plank are considerably less noticeable and difficult to detect upon casual observation. Placing bevels and pattern elements on the laminate flooring plank in this way texture creates optical noise in the form of confusing visual cues near the plank edge. The observer loses sight of the plank edges amidst all of those competing visual cues offered by the bevels, making the plank edge less noticeable. Furthermore, the present invention can use carefully placed design elements having embossed-in-register surface textures to draw the eye of the observer away from the edges of the plank and direct the eye towards the interior region of the plank.

Figure 2:
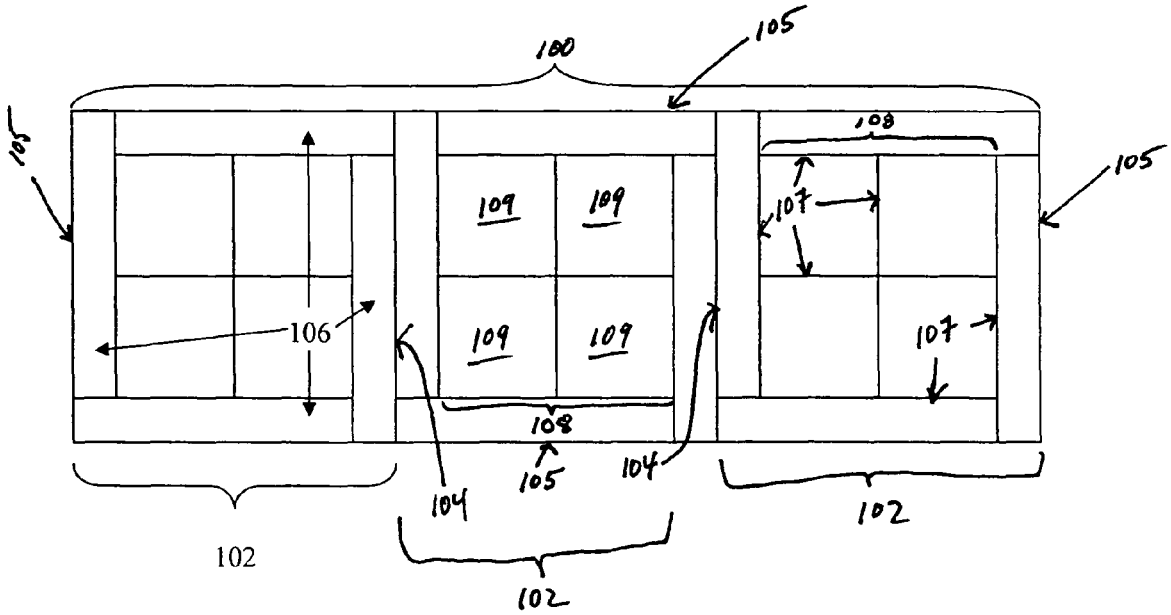
FIG. 2 illustrates a laminate flooring plank according to a first embodiment of the present invention.

In a first embodiment of the present invention, illustrated in FIG. 2, a flooring plank 100 is divided into a number of pattern sub-units, or tiles, 102. The tiles 102 have a square shape whose sides have a length equal to the width of the plank (the width referring to the length of the short sides of the rectangular shaped plank). The length of the plank is equal to an integer multiple of the length of the squares (i.e. the length of the plank is an integer multiple of the width of the plank). Between each of the tiles 102 is a very thin tile boundary bevel ("micro-bevel") 104, which is embossed-in-register on the surface of the plank 100. This tile boundary bevel 104 between tiles 102 runs across the entire width of the plank 100. In addition, another bevel, an edge bevel 105, is located at the edge of the plank 100 and along the top and bottom of each tile 102, thereby creating a continuous bevel 105 along the top and bottom edges of the plank 100 and at the edges at the short sides of the plank 100.

In the example illustrated in FIG. 2, flooring plank 100 has three tiles 102 separated by tile boundary bevels 104. In addition, the tiles 102 also include other decorative elements. These decorative elements are selected so as to provide enough regularly spaced and repeating lines and bevels so as to make it difficult for the eye of the casual observer of the installed flooring to see the seams between planks. For example, in the plank of the present embodiment, the tiles 102 include further decorative pattern elements in the form of strips 106 and blocks 108. These decorative pattern elements are not separate planks, but also creates an identical step-shaped arrangement of bevels 110. This step shape 110 draws the eye of the observer diagonally away from the bevel 105 at the edge of the plank towards the interior. As the eye of the observer travels along either the bevel 105 at the edge of the plank or along any of the parallel nearby interior bevels 107 of the border strips 106, the eye will come to this step shape 110 and follow it into the interior of the plank to the blocks 108, which serve as another decorative pattern element further drawing the observer's attention away from the plan edge.

The blocks 108 are a decorative element that geometrically contrasts in size and arrangement with the strips along the border. In the example illustrated in FIGS. 2 and 3, the block 108 of a tile 102 is simply an arrangement of four quadrants 109 separated by interior bevels 107. The interior bevels 107 intersect in the center of the block 108, and form a focal point or rest point for the observer's eye that is far from the edge of the plank.

In other words, by crowding the edge of each tile with many parallel and closely spaced interior bevels 107 but placing only two intersecting interior bevels 107 in the center of the tile 102, the arrangement of interior bevels 107 draws the eye away from the edge to come to rest at the center of the tile 102. Placing a number of tiles 102 adjacent one another on a single plank, has the effect that when two planks 100 are placed adjacent one another, it becomes difficult to determine which tiles 102 are at the ends of the plank 100 (i.e. adjacent the short sides of the plank).

In other words, when planks 100 are installed adjacent one another, their respective edge bevels 105 are adjacent one another, creating an appearance similar to a single bevel 107 rather than two distinct edge bevels 105. This is accomplished by precise embossing-in-registration and highly accurate placement of this very narrow edge bevel 105 rather are elements of the design on the decor paper of the single unitary plank 100. In this embodiment, the strips 106 are nearly as long as, but shorter than, the width of the plank. In fact, the length of the strips 106 are shorter than the width of the plank by an amount equal to the width of the strips 106. Having these dimensions allows the strips to be placed around the edge of the tile 102 to form a square shaped border, such that the end of each strip 106 abuts the side of another strip 106.

Figure 3:
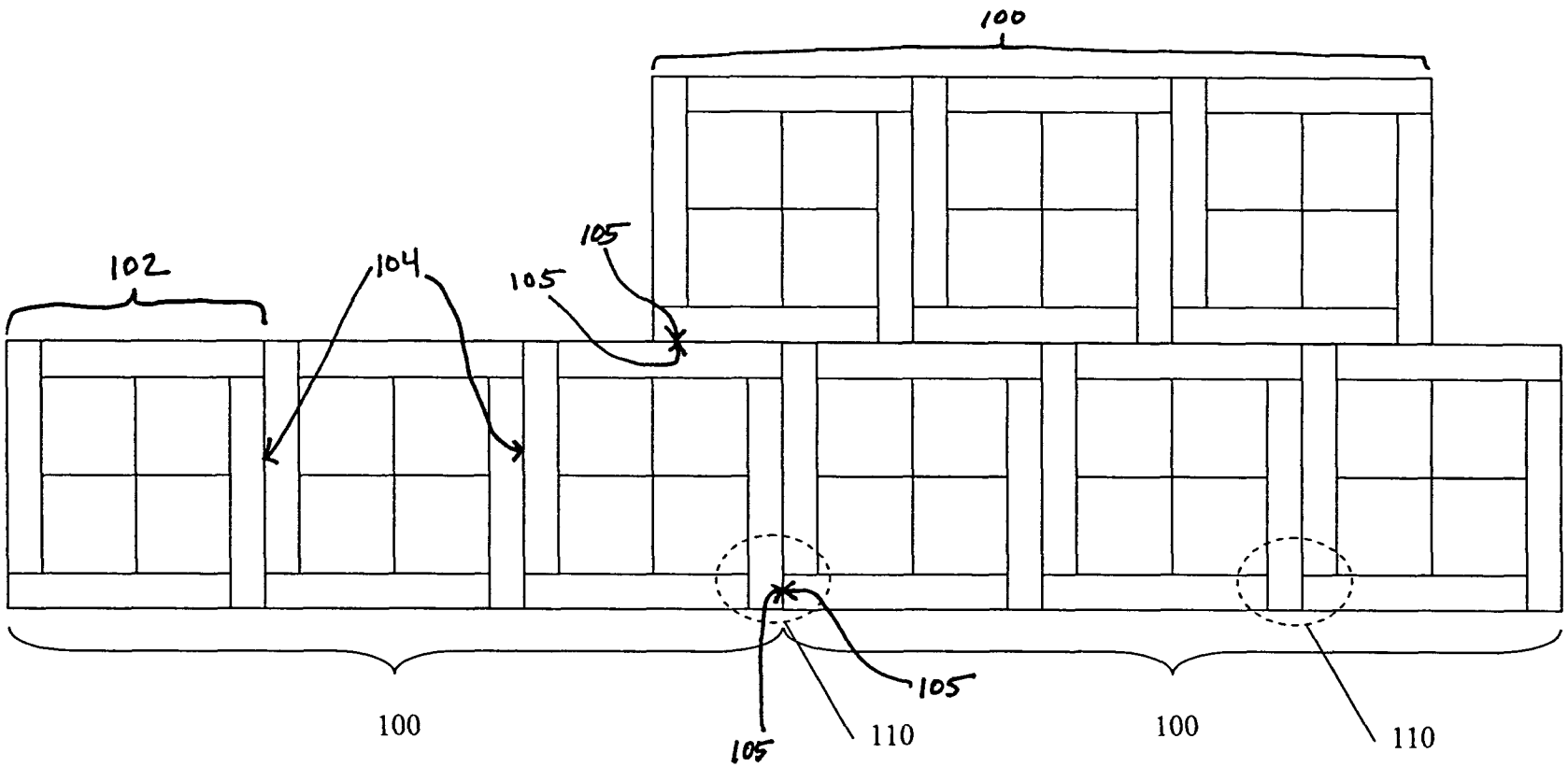
FIG. 3 illustrates an installed group of laminate flooring planks according to a first embodiment of the present invention.

In addition, each of the strips 106 has a bevel 107 placed where the edge of the strip 106 lies within the decorative pattern. An edge of any strip 106 that is also a boundary between adjacent tiles 102 of the plank is provided with tile boundary bevels 104. Doing so has the effect of adding an interior bevel 107 that is parallel and close to the bevels 105 along the edge of the plank 100. Because these bevels 107 lie within the pattern of a tile 102, they are referred to as interior bevels, or interior micro-bevels. When planks 100 are placed adjacent one another vertically and horizontally, as illustrated in FIG. 3, the numerous bevels 107 of the strips 106 located near the edges of the planks makes the edge bevel 105 near the plank edge more difficult to see, because to the eye of the observer interior bevels 107 and edge bevels 105 appear identical. In effect, the bevel 105 at the plank edge is hidden among identical looking bevels 107 that are close to it and parallel with it. The more complex and geometric the arrangement of bevels 107 in the pattern of the tile 102 the more difficult it becomes to distinguish edge bevels 105 from interior bevels 107, and the more likely it is that the eye of the observer will focus somewhere in the interior of the plank and away from the edge.

In addition, the placement of strips 106 in the square border arrangement creates a step-shaped arrangement of bevels 110 between the tiles 102 of a single plank, but at precisely the right distance from the edge of the surface of the plank 100. For this reason, when edge bevels 105 are placed on all four sides of the plank 100, the individual width of these edge bevels 105 should be such that two adjacent edge bevels 105 of two adjacent planks 100 have a combined width equal to the width of the bevels 104 between tiles. If edge bevels 105 are placed only on two of the four sides of the plank 100, then the edge bevels 105 have the same width as the bevels 104 between tiles. In alternative aspects of this and other embodiments of the invention, the interior bevels 107 and the tile boundary bevels 104 have the same width and appearance.

Each of the strips 106 and the blocks 108 have a wood pattern with an embossed-in-register wood surface texture that matches up embossed surface features and marks in the decorative pattern.

In addition to the arrangement of bevels, the hiding of the plank edges is also achieved by the embossed-in-register surface texture within the decorative elements of the plank. For example, the strips 106 and blocks 108 have embossed-in-register wood textures, in which an wood grain surface texture is embossed into the surface of the plank to precisely match and coincide with the wood grain pattern on the printed on the decor paper. Specifically, pits and grooves of the wood grain surface texture are embossed on to dark lines or spots on the decor paper. This gives the laminate flooring plank a realistic look because the feel of the texture matches what the eye sees in the pattern. In addition, the surface texture allows light to play across the surface of the plank and form shadows in the wood grain grooves and pits just as it would with a real wood surface.

The ultra-realistic embossed-in-register surface texture can be used to hide the plank edges by arranging a number of pattern elements whose wood grains run in different directions. For example, in the plank of FIG. 2, the strips 106 have a wood grain texture in which the direction of the wood grain in the pattern is roughly parallel to the long side of the strip 106. It is not necessary for the grain to be precisely parallel to the long side to achieve this effect. Because adjacent strips 106 of a given tile 102 of the plank 100 are perpendicular to each other, their wood grains will run perpendicular to each other. Thus, as the observer looks at the pattern within each strip 106, their eye will follow the wood grain to the end of the strip, and turn away from the plank edge bevel 105 to follow the wood grain of the adjacent, perpendicular strip. This prevents the observer's eye from lingering over the plank edge and edge bevel 105 long enough to become aware that it is the end of the laminate flooring plank 100. Furthermore, the embossed-in-register texture of a strip 106 will catch the light differently than the texture of an adjacent, perpendicular strip 106, making the grain texture more noticeable on one strip than the other. This creates additional details within the plank's interior and away from the plank edge bevel 105 for the eye to focus on.

Likewise, the block 108 within each tile 102 has an embossed-in-register wood grain texture. In the examples illustrated in FIGS. 2 and 3, the block 108 is further divided into four quadrants 109 by the intersecting bevel lines 107, as discussed above. Each of these four quadrants 109 has a square shape, and each may have a different wood grain pattern running in a different direction than the grain in the neighboring quadrants. Positioning the texture in this way forces the eye to follow the grain from quadrant to quadrant and come to rest around the center of the block 108 where the two bevel lines 107 intersect. The use of the surface texture in the quadrants 109 of block 108 reinforce the prominence of the point at the center of the block 108 where the bevels intersect as the ultimate focal point of the tile 102, which in turn achieves the effect of making the plank edge bevel 105 less noticeable and less prominent.

It is not necessary for the blocks 108 or the quadrants to be perfectly square, and in fact variation in the widths and shapes of all of the design elements will achieve a greater overall look of natural randomness. As long as there are a multitude of bevels in the interior of the plank that move the eye away from the plank edge toward the plank interior, the edge of the plank becomes difficult to see.

In addition, in other aspects of this and the other embodiments discussed below, the bevels between tiles of a single unitary plank may have a different width than the bevels between strips or other pattern elements within a tile. As long as the edge bevels that are located around the edges of the planks are related to the width of the bevels between the tiles such that the combined width of two adjacent edge bevels of two adjacent planks equals the width of the bevel between two tiles of a plank, the edges of the planks will be effectively disguised, and the appearance of a natural wood floor will be maintained.

Figure 4:
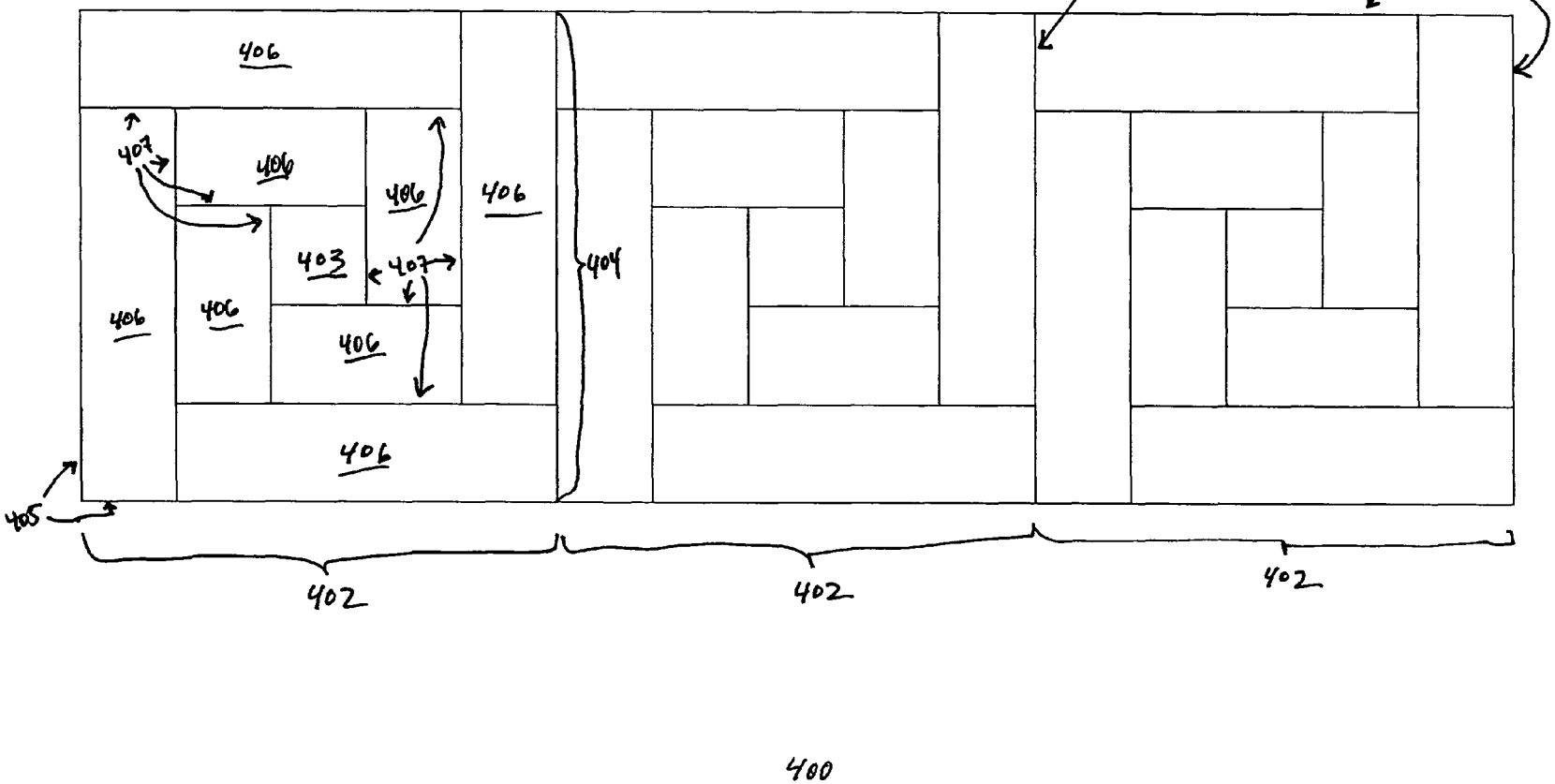
FIG. 4 illustrates a laminate flooring plank according to a second embodiment of the present invention.

By way of further example, FIG. 4 illustrates a second embodiment of the invention in which plank 400 has wooden strips 406 arranged in concentric squares around a center square 403. The center square 403 has sides equal to the width of the strips 406, so that a single square tile 402 has a width equal to five times the width of a strip. Also, as discussed above, the length of the sides of a tile 402 is also equal to the overall width of the plank 400.

In this embodiment, each of the strips 406 has an embossed-in-registration wood pattern bounded on all sides by narrow bevels, or micro-bevels. In FIG. 4, the micro-bevels are indicated by the lines outlining the strips. The wood grain pattern of each of the strips runs substantially parallel to the lengthwise direction of the strip, so that the wood grains of the strips in the tile are running in a number of directions.

More specifically, in this illustrated embodiment tiles 402 of a single plank 400 have a tile boundary bevel 404 between them. The boundaries between wood strips 406 and the center square 403 within the tile 402 are interior bevels 407. The edges of the plank 400 have edge bevels 405. As discussed above, the bevels 404 and 407 may have the same width or different widths, however the effect of hiding or masking the plank edges is enhanced if the bevels 404 and 407 have the same width, and if the widths of the edge bevels 405 are selected so that two adjacent edge bevels 405 have a combined width equal to the width of the bevels 404 between tiles 402 of a single unitary plank 400. This can be accomplished if the edge bevels 405 are half the width of the bevels 404, but it can also be accomplished by making an edge bevel 405 on one side of the plank narrower and the edge bevel 405 on the opposite side of the plank wider. Furthermore, the edge bevel 405 on one side can be equal to the width of the bevel 404, in which case no edge bevel 405 would placed on the opposite side of the plank.

The micro-bevels 404 have a width less than one millimeter, and may be as narrow as half a millimeter wide or less, and the bevel 405 around the edge of the plank has a width half of the width of the micro-bevels in the interior. This keeps the eye moving around the pattern of the tile and away from the edges of the planks. Furthermore, when planks 400 are installed adjacent one another, two fractional-width bevels are placed next to each other to form a single bevel whose width is the same as the width of the micro-bevels in the interior of the plank. Because of this, it is very difficult to detect which bevels coincide with plank edges and which bevels are interior bevels. In other words, the bevels are precisely and accurately embossed-in-registration with the pattern elements in the design so that when all of the planks are installed, the eye only sees a multitude of bevels of the same width, and therefore cannot easily or quickly detect the edges of the planks.

Figure 5:
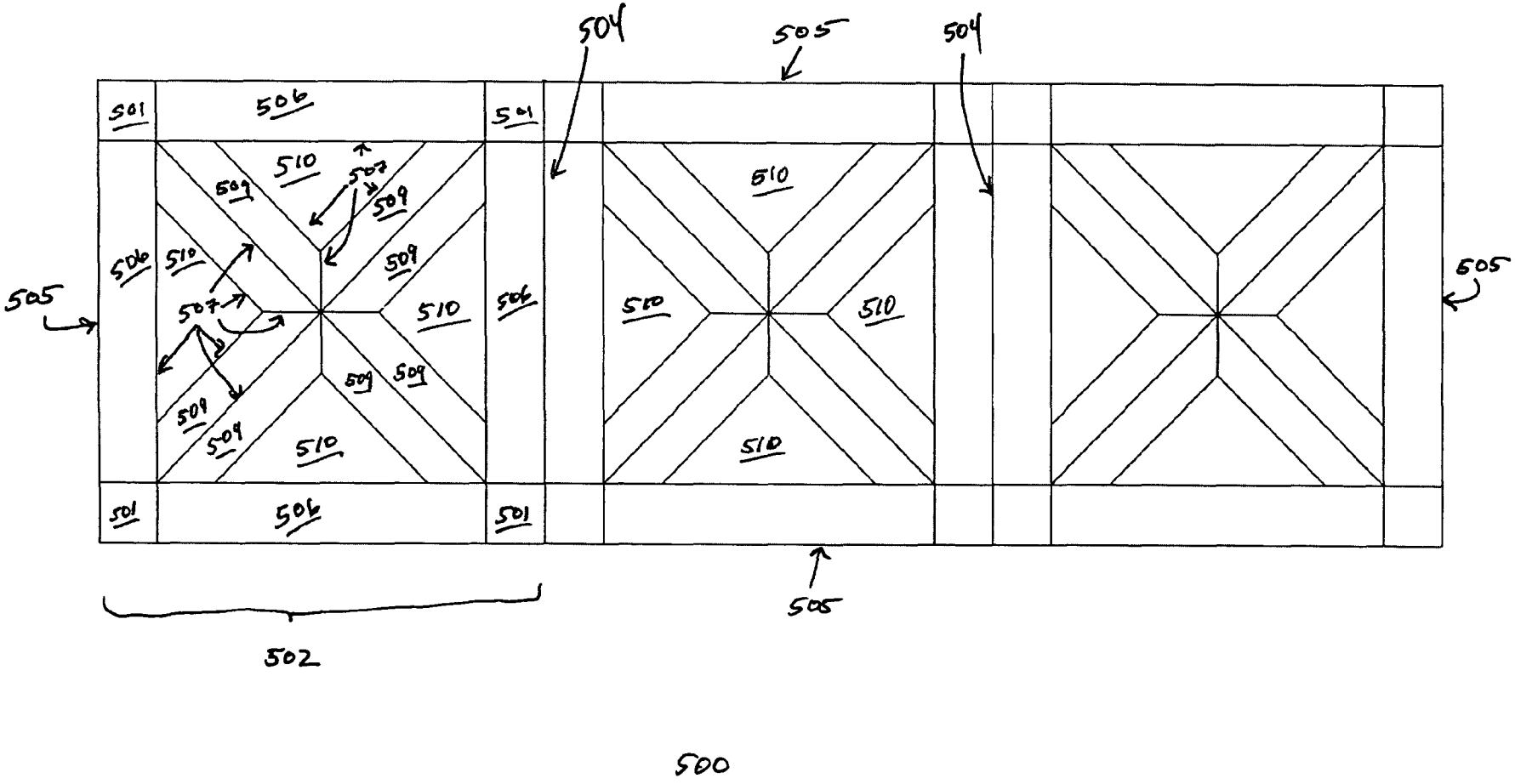
FIG. 5 illustrates a laminate flooring plank according to a third embodiment of the present invention.

A third embodiment is illustrated in FIG. 5. Here, the design of the tiles 502 within a plank 500 of the system is more symmetrical than in FIGS. 2-4. At the outside corners of each tile 502 are squares 501 having embossed-in-registration surface textures within them, and the squares 501 have micro-bevels 507 along their boundaries within the tile 502. Between tiles 502 of the plank 500 are tile boundary bevels 504. Between the squares 501 are wood strips 506 running vertically and horizontally to define a square border of the tile 502. Again, these strips 506 have embossed-in-registration surface textures and are bounded by micro-bevels 507 in the interior of the tile 502 and edge bevels 505 where a side of the strip falls on a plank edge. In another aspect of this embodiment, not illustrated, instead of fractional width edge bevels 505 on the plank edges, the flooring plank 500 can have a full width edge bevel 505 on one plank edge and no bevel on the opposite plank edge.

Returning to FIG. 5, inside the square border are strips 509 running in pairs along the diagonals of the tile, leaving four triangular shapes 510 around the center of the tile. Each of these triangular shapes 510 and strips 509 also have embossed-in-registration surface textures and micro-bevel 507 bordering them. In a further aspect of this embodiment, the strips 509 or the triangular shapes 510 may have bevels of a different width than bevels 504, 505, and 507. In this illustrated embodiment, there are three tiles on a single unitary plank, however it is understood the invention in any embodiment contemplates any number of tiles per plank greater than one.

In the example illustrated in FIG. 5, there are a large number of diagonal bevels 507 running toward the center of the tiles 502 and short bevels 507 near the tile corners. Because the bevels 504 between tiles within a single plank are the same size as the bevels between a pair of adjacent planks, the plank edges are not noticeable, and the eye follows the diagonal design elements to come to rest at, or focus on, the center of the tiles 502, which are the places within the plank 500 furthest from the plank edges.

In this way, the use and placement of precision micro-bevels within the planks and along the plank edges in conjunction with embossed-in-registration surface textures creates a laminate flooring system which effectively hides the edges of planks while simultaneously creating the illusion that the flooring is made of the individual physical elements corresponding to the pattern elements of the tiles, such as the wooden strips and other geometric shapes, and disguising the fact that the floor is in fact made of a regular arrangement of large unitary rectangular planks each having an number of embossed-in-registration tile pattern formed thereon.

It is important to note that in a laminate flooring system using these tiles, the wood grain patterns of the strips, squares and other geometric shapes may differ from one plank to the next. In other words, for example, the pits, grain lines, knots and other similar wood pattern details located in one position of one plank 100 of FIG. 2 may be different from the wood pattern details at the corresponding position on another plank 100. This is desirable because it allows for a more random look to the wood pattern in the laminate flooring. What does not differ among the planks of a given design is the width and placement of the bevels, specifically the tile boundary bevels an the edge bevels.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A laminate flooring system, comprising:

a unitary laminate flooring plank having a length and a width, the length being greater than the width, wherein the flooring plank is divided into a plurality of sub-units;

an edge bevel extending continuously along a perimeter of the flooring plank;

at least one boundary bevel extending along the width of the flooring plank to separate adjacent sub-units;

a plurality of interior bevels disposed at a central area of the sub-units and defining a plurality of design elements;

wherein a width of the boundary bevel is substantially equal to a width of the interior bevel, and the width of the edge bevel is approximately equal to half the width of the boundary bevel.

2. The laminate flooring system as claimed in claim 1, wherein the boundary bevel is embossed in registration on the surface of the flooring plank.

3. The laminate flooring system as claimed in claim 1, wherein the edge bevel is a micro-bevel.

4. The laminate flooring system as claimed in claim 1, wherein the boundary bevel and interior bevels are micro-bevels have a width of less than a millimeter.

5. The laminate flooring system as claimed in claim 1, wherein the decorative elements are elements on a single decor paper defining a decorative pattern spanning the length of the flooring plank.

6. The laminate flooring system as claimed in claim 5, wherein the decorative pattern is disposed on a surface of the flooring plank and the decorative pattern is embossed-in-registration with a surface texture, relative to the edge bevel.

7. The laminate flooring system as claimed in claim 6, wherein the decorative pattern further comprises a natural wood grain pattern and the surface texture comprises a matching natural wood grain surface texture.

8. A laminate flooring system, comprising:

a unitary laminate flooring plank having a length and a width, the length being greater than the width, wherein the flooring plank is divided into a plurality of sub-units;

an edge bevel extending along at least a portion of a perimeter of the flooring plank;

at least one boundary bevel extending along the width of the flooring plank to separate adjacent sub-units;

a plurality of interior bevels disposed at a central area of the sub-units and defining a plurality of design elements;

wherein a width of the boundary bevel is substantially equal to a width of the interior bevel, and the width of the edge bevel is approximately equal to half the width of the boundary bevel.

9. The laminate flooring system as claimed in claim 6, wherein the edge bevel extends continuously along at least one side of the flooring plank.

10. A laminate flooring system, comprising:

at least two unitary laminate flooring planks, each of said laminate flooring planks divided into at least two adjacent square tiles, said flooring planks having a rectangular shape having a width corresponding to a short side and a length corresponding to a long side, and each of said square tiles having four sides and each of said sides having a length equal to the width of the respective flooring plank;

a boundary bevel disposed between adjacent tiles of each of the flooring planks, wherein the boundary bevel is embossed-in-registration on the surface of the respective flooring plank; and an edge bevel extending along each edge of the tiles that falls on an edge of the respective flooring plank, wherein said two flooring planks are placed adjacent one another so that edge bevels of the respective flooring planks are also adjacent; and wherein the combined width of the adjacent edge bevels equals the width of the boundary bevel so that the edges between flooring planks is indistinguishable from the boundary bevel between adjacent tiles of the respective flooring plank.

11. The laminate flooring system as claimed in claim 10, the tiles comprising a plurality of decorative elements separated by interior bevels, wherein the decorative elements are elements on a single decor paper defining a decorative pattern spanning the length of the flooring plank.

12. The laminate flooring system as claimed in claim 11, wherein the decorative pattern is disposed on a surface of the flooring plank and the decorative pattern is embossed-in-registration with a surface texture, relative to the edge bevel.

13. The laminate flooring system as claimed in claim 12, wherein the decorative pattern further comprises a natural wood grain pattern and the surface texture comprises a matching natural wood grain surface texture.

14. The laminate flooring system as claimed in claim 10, wherein the boundary bevel has a width less than one millimeter, and the width of the interior bevel is substantially equal to the width of the boundary bevel.

* * * * *